US005344577A

United States Patent [19]

Deckman et al.

[11] Patent Number: 5,344,577

[45] Date of Patent: Sep. 6, 1994

[54] METHODS FOR REDUCING WEAR ON SILICON CARBIDE CERAMIC SURFACES

[75] Inventors: Douglas E. Deckman, Mullica Hill, N.J.; Stephen M. Hsu, Germantown, Md.

[73] Assignee: The United States of America as represented by the Secretary of Commerce, Washington, D.C.

[21] Appl. No.: 883,313

[22] Filed: May 14, 1992

[51] Int. Cl.[5] ..... C10M 135/22; C10M 135/28

[52] U.S. Cl. ..... 252/45

[58] Field of Search ..... 252/12.2, 45

[56] References Cited

U.S. PATENT DOCUMENTS

| | | | |
|---|---|---|---|
| 3,909,426 | 9/1975 | Horodysky et al. | 252/45 |
| 3,944,491 | 3/1976 | Baldwin | 252/45 |
| 4,416,788 | 11/1983 | Apikos | 252/45 |
| 4,449,004 | 5/1984 | Degani et al. . | |
| 4,582,618 | 4/1986 | Davis . | |
| 4,822,506 | 4/1989 | Dubas . | |
| 4,826,612 | 5/1989 | Habeeb et al. . | |

OTHER PUBLICATIONS

Hsu, "Advanced Lubrication Concepts and Lubricants", Engineered Materials for Advanced Friction and Wear Applications, Smidt et al Editors, ASHM International, Metals Park, Ohio, 1988, pp. 135–142 (month unknown).

Hsu, "Boundary Lubrication of Materials", MRS Bulletin, Oct. 1991, pp. 54–58.

*Primary Examiner*—Jacqueline V. Howard

*Attorney, Agent, or Firm*—Holly D. Kozlowski

[57] ABSTRACT

Methods for reducing wear on silicon carbide ceramic surfaces comprise contacting the surface with a lubricating oil composition including an organic sulfide. Preferred organic sulfides are of the formula $R^1$—S—$(S)_n$—$R^2$ wherein $R^1$ and $R^2$ are individually selected from the group consisting of alkyl, aryl, arylalkyl and alkaryl groups and hydrogen, but not both $R^1$ and $R^2$ are hydrogen, and n is 0, 1 or 2.

11 Claims, 3 Drawing Sheets

METHODS FOR REDUCING WEAR ON SILICON CARBIDE CERAMIC SURFACES

FIELD OF THE INVENTION

The present invention relates to methods for reducing wear on silicon carbide ceramic surfaces. More particularly, the present invention relates to such methods which employ a lubricating oil composition including an organic sulfide.

BACKGROUND OF THE INVENTION

Silicon carbide is a material which has a low density (approximately 3.25 g/cm$^3$), a high hardness and excellent high-temperature strength. This combination of properties makes silicon carbide suitable for use in many tribological applications such as wear parts, pumps, rollers, seals, engine components and the like. Because many conventional anti-wear agents do not successfully protect silicon carbide from wear, the use of silicon carbide in many of these applications has been severely hindered. For ceramics, particulary silicon carbide ceramics, conventional lubricant chemistry including phosphorus compounds (for example, in TCP and ZDDP), sulfur compounds (for example, sulfurized olefins), chlorine compounds (for example, chlorinated paraffins) and the like have not been successful in providing anti-wear protection.

Generally, a lubricant functions by preventing and/or modifying stresses associated with asperity contacts. This may be accomplished by hydrodynamic lift and/or the formation of surface protective films. Under boundary lubrication conditions, surface films are generated between the lubricant and the substrate material as a result of chemical reactions. In the case of metals, the films are dominated by organometallic species in conjunction with the formation of high molecular weight products. Thus, it is an important feature that one or more lubricant components can react with the surface to form a protective boundary layer film. The speed at which such a reaction occurs is also an important feature in determining the suitability of a particular lubricant. That is, the reaction which results in the formation of the boundary layer film must be sufficiently fast as compared with the rubbing wear-causing action. A slow reaction rate would not yield sufficient products to form a surface-protective film. On the other hand, lubricant components which react too quickly with the surface which is to be protected induce corrosive wear.

Thus, there is a need for providing methods and compositions for reducing wear on silicon carbide ceramic surfaces.

SUMMARY OF THE INVENTION

Accordingly, it is an object of the present invention to provide methods for reducing wear on silicon carbide ceramic surfaces, particularly surfaces which are subjected to wear by contact with metal surfaces, ceramic surfaces, or the like. This and additional objects are provided by contacting the silicon carbide ceramic surface with a lubricating oil composition including an organic sulfide. The lubricating oil composition including an organic sulfide allows the formation of a boundary layer film on the silicon carbide surface. The resulting boundary layer film reduces wear on the surface resulting from contact of the surface with metals, ceramics and the like.

These and additional objects and advantages will be more fully apparent in view of the following detailed description.

BRIEF DESCRIPTION OF THE DRAWINGS

The following detailed description may be more fully understood in view of the accompanying drawings in which.

DETAILED DESCRIPTION

Figure 1:
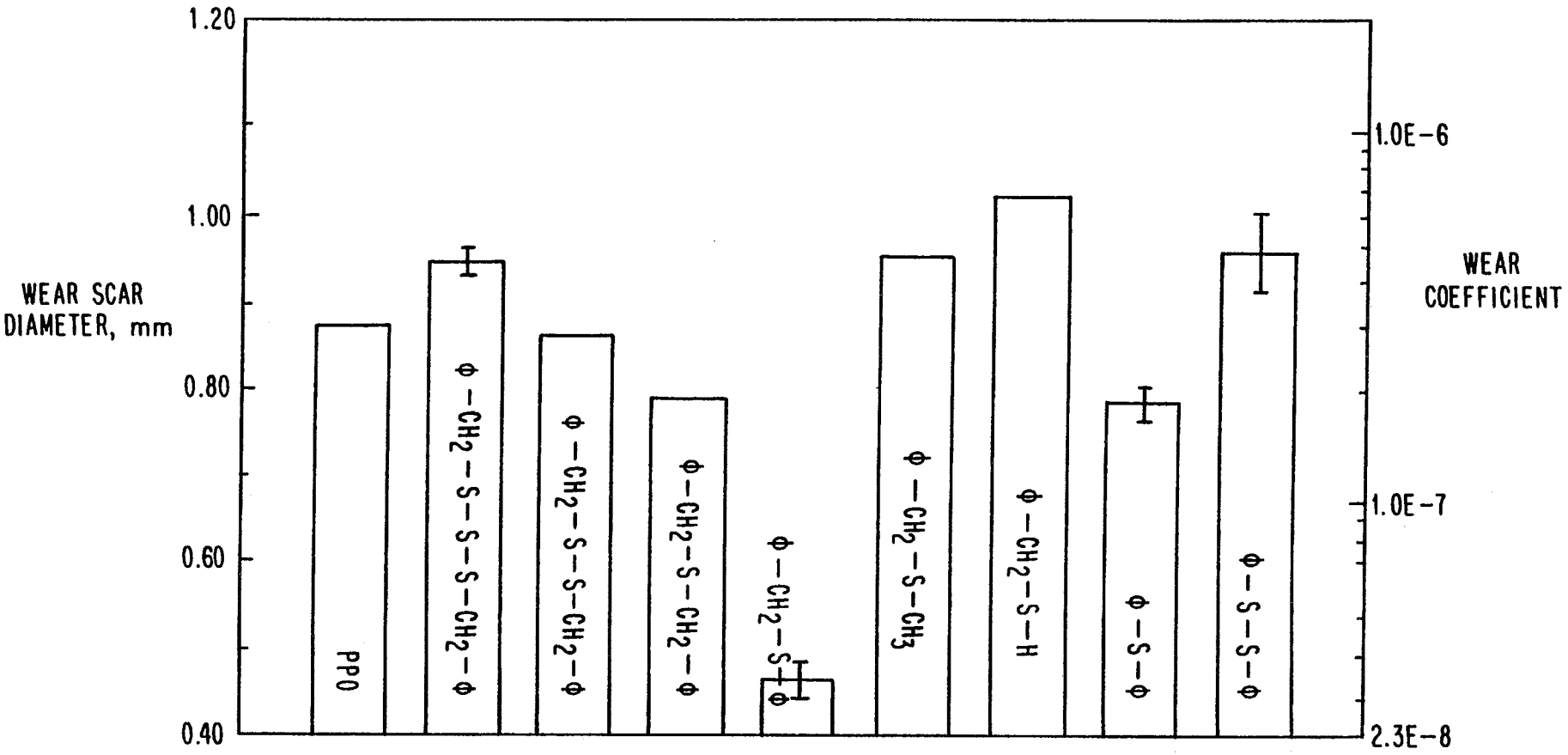
FIG. 1 sets forth the effect of lubricating oil compositions containing various organic sulfides on the wear of silicon carbide as described in Example 1.

The present invention relates to methods for reducing wear on silicon carbide ceramic surfaces. The wear may be caused by contact with metal parts, other ceramic materials or the like. The methods of the present invention comprise contacting the silicon carbide ceramic surfaces with a lubricating oil composition which includes an organic sulfide. In a preferred embodiment, the organic sulfide is of the formula $R^1—S—(S)_n—R^2$ wherein $R^1$ and $R^2$ are individually selected from the group consisting of alkyl, aryl, aralkyl and alkaryl groups and hydrogen, but not both of $R^1$ and $R^2$ are hydrogen, and n is 0, 1 or 2. In a preferred embodiment, one of $R^1$ and $R^2$ is a benzyl group or a phenyl group. Organic sulfides within the aforementioned formula and particularly suitable for use in the present invention include benzyl phenyl sulfide, benzyl disulfide, octadecyl mercaptan, dibenzyl disulfide, benzyl trisulfide, dibenzyl trisulfide, diphenyl sulfide and dibenzyl sulfide, and the like. A particularly preferred organic sulfide for use in the present methods comprises benzyl phenyl sulfide.

The lubricating oil compositions which include the organic sulfide may comprise any conventional lubricating oil. Suitable lubricating oils include liquid hydrocarbons such as mineral lubricating oils, synthetic lubricating oils, and mixtures thereof. The mineral oils may include paraffinic, naphthenic and/or other aromatic components. The synthetic oils may include diester oils such as di(2-ethylhexyl) sebacate, azelate and adipate; complex ester oils such as those formed from dicarboxylic acids, glycols and either monobasic acids or monohydric alcohols; polyolester oils such as esters of pentaerythritol and/or trimethylol propane; and other synthetic oils (including synthetic hydrocarbons) known in the art. A preferred lubricating oil for use in the methods of the present invention comprises purified paraffin oil (PPO).

The organic sulfide is included in the lubricating oil composition in an amount sufficient to reduce wear on a silicon carbide ceramic surface. In most instances, the use of the organic sulfide in an amount of from about 0.1 to about 10 weight % of the composition will be suitable with the range from about 1 to about 10 weight % being preferred.

The lubricating oil compositions employed in the methods of the present invention may further include other additives conventionally employed in the lubricant art. Such additives include, but are not limited to, dispersants, other anti-wear agents, antioxidants, corrosion inhibitors, detergents, pour point depressants, extreme pressure additives, viscosity index improvers, and the like.

The methods of the present invention are demonstrated by the following examples. Throughout the examples and the remainder of the specification, reference to parts and percentages are by weight, unless otherwise specified. Various silicon carbide materials were employed in the examples, and their compositions and properties are set forth in the following Table I.

TABLE I

Typical Chemical Analyses of Various SiC Materials (Obtained from the Manufacture)

| Composition | Hexoloy SA | NC203 | ESK PostHIP | Pure Carbon |
|---|---|---|---|---|
| SiC | 99.2 | 94.0 | 98.5 | 87.5 |
| $SiO_2$ | .15 | — | — | — |
| Al | .10 | 1.48 | 0.3 | — |
| Fe | .01 | .24 | — | — |
| W | — | 2.5 | — | — |
| B | .45 | .005 | — | — |
| $C_{free}$ | — | — | 1max | — |
| $Si_{free}$ | — | — | — | 12.5 |
| Properties | | | | |
| Processing | Sintered | Hot Pressed | Post Hipped | Reaction Bonded |
| Hardness, GPa | 27.4 | 24.5 | — | 24.0 |
| Young's Modulus, GPa | 406 | 440 | 430 | 365 |
| Poisson's Ratio | 0.14 | 0.168 | 0.16 | 0.24 |
| Thermal Conductivity, w/m.k, RT | 120 | 101 | 110 | 150 |
| Fracture Toughness, MPa $m^{0.5}$ | 4.1 | 3.8 | 3.2 | — |
| Porosity, % | ~2 | 1.7 | <1 | — |
| Average Grain size, μm | 5 | 1.5 | 3.8 | 10 |
| Microstructure | Equiaxle | Equiaxle | Bimodal | Equiaxle |

EXAMPLE 1

In this example, wear tests were conducted on a silicon carbide material comprising NC203/Hexoloy couples using various lubricant compositions comprising purified paraffin oil (PPO) and organic sulfide additives. Specifically, wear tests were conducted on a four-ball wear tester using a sliding speed of 600 rpm (0.23 m/s), an applied load of 70 kg, a test period of one hour and a bulk temperature of 60° C. These tests conditions produced a mean Hertzian pressure of 0.66 GPA and result in wear in the boundary lubrication region. A ball-on-three-flat (BTF) geometry was employed as a test configuration. Wear tested specimens were 12.67 mm (0.5") diameter silicon carbide balls and 0.63 mm (0.25") diameter flats. The ball/flat couples employed comprised NC203/Hexoloy couples. After testing, the specimens were rinsed with solvent and the wear scars were determined using an optical microscope.

The compositions employed in this example comprised paraffin oil purified by passing the oil through a column of activated alumina, and an organic sulfide material as indicated in FIG. 1. The respective compositions contained the organic sulfide additive in an amount which provided a 0.78 weight % sulfur content.

The results set forth in FIG. 1 demonstrate that the composition comprising PPO and benzyl phenyl sulfide significantly reduced the wear scar diameter and the wear coefficient on the test piece as compared with the use of PPO without the organic sulfide additive. Additionally, a boundary action film was observed within the wear scar of the silicon carbide test piece lubricated by the composition containing PPO and benzyl phenyl sulfide.

EXAMPLE 2

Figure 2A:
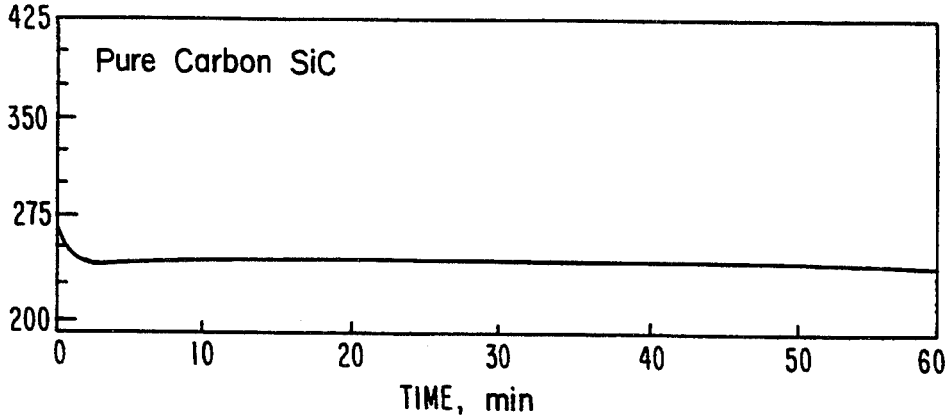
FIGS. 2A and 2C set forth the effects of a lubricating oil composition comprising benzyl phenyl sulfide on the lubrication of different silicon carbide materials as described in Example 2.
Figure 2B:
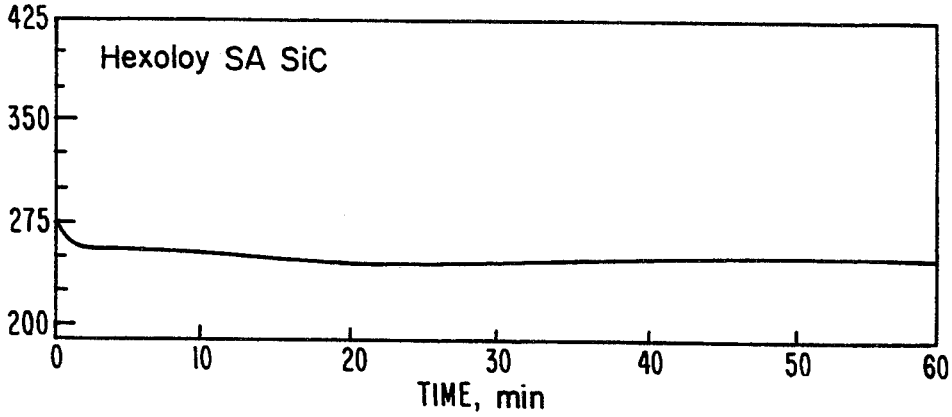
Figure 2C:
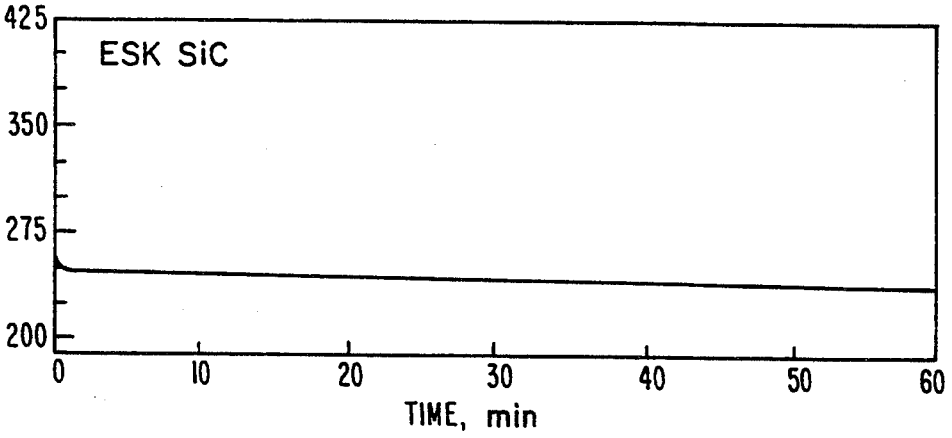
Figure 3:
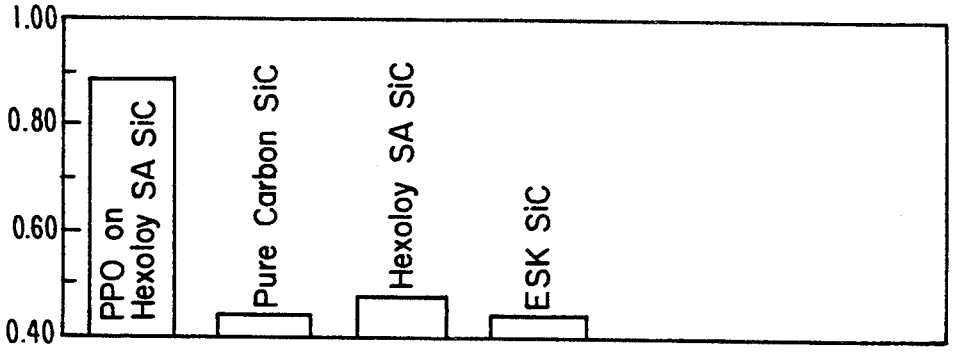
FIG. 3 sets forth the effects of a lubricating oil composition comprising benzyl phenyl sulfide on the wear of several silicon carbide materials as described in Example 2.

In this example, a lubricating composition containing PPO and 4.878 weight % benzyl phenyl sulfide was used as a lubricant for three different types of silicon carbide materials, namely pure carbon, Hexoloy SA and ESK as described in Table I. For each material, the friction force was determined as a function of time. The wear scar diameter was also measured in accordance with the procedures set forth in Example 1. The results of the friction force and wear scar diameter measurements are set forth in FIGS. 2A–2C and 3, respectively. As indicated in FIGS. 2A–2C, each silicon carbide material was provided with a lubricating film, and as indicated in FIG. 3 the lubricating composition significantly reduced wear scar diameters. Thus, the composition comprising PPO and benzyl phenyl sulfide is an effective wear reducing additive for various types of silicon carbide materials.

EXAMPLE 3

Figure 4:
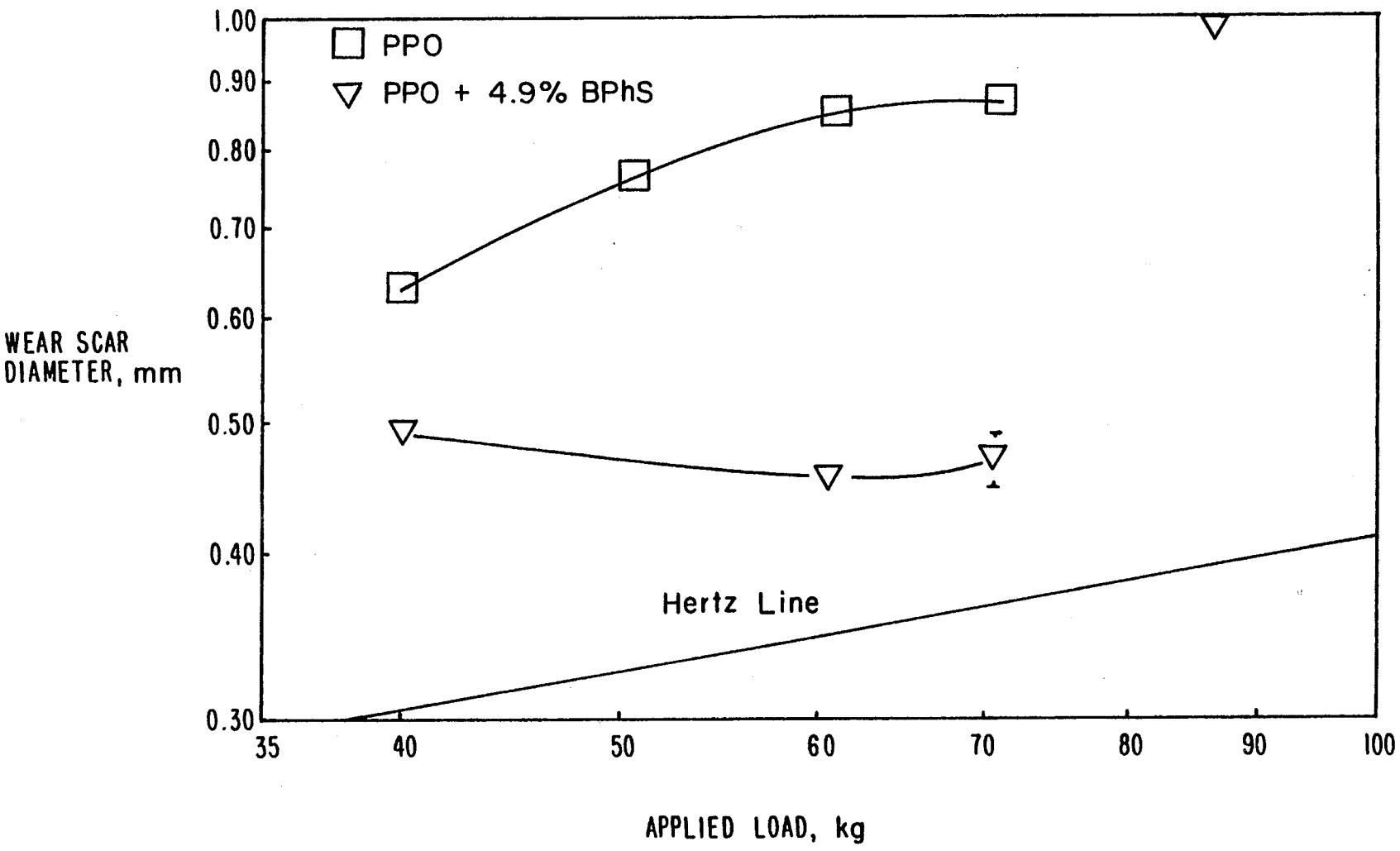
FIG. 4 sets forth the effect of an applied load on the wear of a silicon carbide couple lubricated by a composition containing benzyl phenyl sulfide as described in Example 3.

In this example, the effect of an applied load on the wear of a NC203/Hexoloy couple was studied. In a first analysis, a lubricating oil composition containing PPO and 4.9 weight % benzyl phenyl sulfide was employed. In a second analysis, a lubricating oil composition containing PPO without an organic sulfide was employed. Wear scar diameter measurements were made in accordance with the procedures described in Example 1. The results of the measurements are set forth in FIG. 4. As indicated in FIG. 4, the composition containing benzyl phenyl sulfide significantly reduced the wear from applied loads from 40 kg to 70 kg.

EXAMPLE 4

In this example, compositions comprising PPO and varying amounts of benzyl phenyl sulfide (BPhS) were employed as lubricants for silicon carbide materials in the form of NC203/Hexoloy couples and ESK/ESK couples. Wear scar diameter measurements were made according to the procedures set forth in Example 1. The results are set forth in Table II.

TABLE II

Effect of Benzyl Phenyl Sulfide as an Anti-wear Additive for ESK and Hexoloy SiC

| | WSD, mm | | Wear Volume $mm^3 \times 10^{-3}$ | | Wear Volume Change, % | |
|---|---|---|---|---|---|---|
| BPhS, % | ESK/ ESK | NC203/ Hexoloy | ESK/ ESK | NC203/ Hexoloy | ESK/ ESK | NC203/ Hexoloy |
| 0 | .667 | .864 | 1.531 | 4.314 | 0 | 0 |
| 2 | .518 | .711 | .557 | 1.978 | −63.6 | −54.2 |
| 3.5 | .490 | .787 | .416 | 2.969 | −70.9 | −31.2 |
| 5 | .435 | .466 | .277 | .365 | −81.9 | −91.5 |
| 7.5 | — | .445 | — | .303 | — | −93.0 |
| 10 | .476 | .694 | .397 | 1.795 | −74.1 | −58.4 |
| 20 | .695 | .690 | 1.805 | 1.754 | +17.9 | −59.3 |

As set forth in Table II, a concentration of 2 to 10 weight % o f the benzyl phenyl sulfide in the lubricating oil composition was most effective in reducing wear on the ESK/ESK couple. Concentrations of from 4 to 8 weight % benzyl phenyl sulfide were particulary effective in reducing wear on the NC203/Hexoloy couple.

EXAMPLE 5

In this example, the effect of sliding speed on the wear of a NC203/Hexoloy couple contacted with a lubricating oil composition containing PPO and 4.9 weight % benzyl phenyl sulfide was examined. Measurements were made in accordance with the procedures described in Example 1. The wear was also represented as a wear coefficient to account for the greater sliding distance which occurs at the higher sliding speed. The results are set forth in Table III.

TABLE III

Effect of Sliding Speed on the Wear of a NC203/Hexoloy SiC Couple

| | 600 rpm (0.23 m/s) | | 1500 rpm (0.57 m/s) | |
|---|---|---|---|---|
| Lubricant | WSD, mm | Wear Coefficient, K | WSD, mm | Wear Coefficient, K |
| PPO | .864 | $5.1 \times 10^{-7}$ | | |
| PPO + 4.9% BPhS | .466 | $4.3 \times 10^{-8}$ | .623 | $5.5 \times 10^{-8}$ |

EXAMPLE 6

In this example, various compositions comprising PPO and organic sulfides were employed for lubricating a silicon carbide NC203/Hexoloy couple. Wear tests in accordance with the procedures described in Example 1 were performed, except that the applied load was changed from 70 kg to 40 kg and the bulk temperature was changed from 60° C. to 200° C. The results of the wear tests are set forth in Table IV.

TABLE IV

Effect of Sulfide Additives on the Wear of SiC at 200° C. and 40 kg

| Additive | Conc. | WDS, mm | Wear Vol., $mm^3 \times 10^{-10}$ | % Change Wear Vol. |
|---|---|---|---|---|
| — | — | 0.750 | 2.45 | 0 |
| Benzyl Sulfide | 1 | .594 | .963 | −60.7 |
| Benzyl Disulfide | 3 | .487 | .433 | −82.3 |
| Octadecyl Mercaptan | 1 | .522 | .572 | −76.7 |
| BPhS | 4.878 | .739 | 2.31 | −5.7 |
| BTriS | 2.25 | .456 | .334 | −86.4 |
| PhDS | 2.658 | .795 | 3.09 | +26.1 |

TABLE IV-continued

Effect of Sulfide Additives on the Wear of SiC at 200° C. and 40 kg

| Additive | Conc. | WDS, mm | Wear Vol., $mm^3 \times 10^{-10}$ | % Change Wear Vol. |
|---|---|---|---|---|
| $\Phi S\phi$ | 4.536 | .568 | .805 | −67.1 |
| $\Phi CH_2SCH_2\phi$ | 5.219 | .558 | .750 | −69.4 |

The preceding examples are set forth to illustrate specific embodiments of the invention and are not intended to limit the scope of the methods of the present invention. Additional embodiments and advantages within the scope of the claimed invention will be apparent to one of ordinary skill in the art.

What is claimed is:

1. A method for reducing wear on a silicon carbide ceramic surface, comprising contacting the silicon carbide ceramic surface with a lubricating oil composition including an organic sulfide in an amount sufficient to reduce wear on the silicon carbide ceramic surface, the organic sulfide being of the formula $R^1—S—(S)_n—R^2$ wherein $R^1$ and $R^2$ are individually selected from the group consisting of alkyl, aryl, aralkyl and alkaryl groups and hydrogen, but not both of $R^1$ and $R^2$ are hydrogen, and n is 0, 1 or 2.

2. A method as defined by claim 1, wherein $R^1$ is a benzyl group.

3. A method as defined by claim 2, wherein n is 0.

4. A method as defined by claim 2, wherein n is 1.

5. A method as defined by claim 2, wherein n is 2.

6. A method as defined by claim 1, wherein the organic sulfide is selected form the group consisting of benzyl phenyl sulfide, benzyl disulfide, octadecyl mercaptan, dibenzyl disulfide, benzyl trisulfide, dibenzyl trisulfide, diphenyl sulfide and dibenzyl sulfide.

7. A method as defined by claim 1, wherein the organic sulfide is benzyl phenyl sulfide.

8. A method as defined by claim 1, wherein the organic sulfide is included in the lubricating composition in an amount of from about 0.1 to about 10 weight percent.

9. A method as defined by claim 8, wherein the organic sulfide is included in the lubricating composition in an amount of from about 1 to about 10 weight percent.

10. A method as defined by claim 1, wherein the lubricating oil comprises purified paraffin oil.

11. A method for reducing wear on a silicon carbide ceramic surface, comprising contacting the silicon carbide ceramic surface with a lubricating oil composition including benzyl phenyl sulfide in an amount sufficient to reduce wear on the silicon carbide ceramic surface.

* * * * *